US007374042B2

(12) United States Patent
Liu

(10) Patent No.: US 7,374,042 B2
(45) Date of Patent: May 20, 2008

(54) TOOL BOX

(75) Inventor: Kuo Chen Liu, Dali (TW)

(73) Assignee: Jeoutay Liu International Co., Ltd., Dali Gonyeh Chu Dali, Taichung Hsien (TW)

( * ) Notice: Subject to any disclaimer, the term of this patent is extended or adjusted under 35 U.S.C. 154(b) by 479 days.

(21) Appl. No.: 11/111,548

(22) Filed: Apr. 20, 2005

(65) Prior Publication Data

US 2007/0023307 A1 Feb. 1, 2007

(51) Int. Cl.
*B65D 85/28* (2006.01)

(52) U.S. Cl. ..... 206/372; 206/379

(58) Field of Classification Search ..... 206/372, 206/373, 379, 376, 377, 378
See application file for complete search history.

(56) References Cited

U.S. PATENT DOCUMENTS 6,079,559 A * 6/2000 Lee ..... 206/378
6,237,451 B1 5/2001 Wei ..... 81/490
6,327,942 B1 12/2001 Mariol et al. ..... 81/177.4
6,634,502 B1 * 10/2003 Yu ..... 206/379
6,840,377 B2 * 1/2005 Yu ..... 206/377
2005/0189250 A1 * 9/2005 Hsu ..... 206/373

* cited by examiner

*Primary Examiner*—Jacob K. Ackun, Jr.
(74) *Attorney, Agent, or Firm*—Charles E. Baxley

(57) ABSTRACT

A tool box includes a housing having a number of orifices formed in an upper wall, and a carrier slidably received in the housing and having a number of socket openings for receiving tool members. The carrier is slidable relative to the housing for selectively moving the tool members in and out of the housing. A spring member may be engaged between the housing and the carrier, for biasing the carrier to move the tool members out of the housing. The carrier includes a bore for slidably receiving a guide post of the housing, and for guiding the carrier to move up and down relative to the housing. An anchoring device may anchor the carrier to the housing at the inwardly storing position.

16 Claims, 4 Drawing Sheets

TOOL BOX

BACKGROUND OF THE INVENTION

1. Field of the Invention

The present invention relates to a tool box, and more particularly to a tool box having a movable or spring-biased holder for movably supporting tool bits, sockets or other tool members therein.

2. Description of the Prior Art

Typical tool boxes comprise a receptacle including a number of cavities or socket openings formed therein for receiving tool bits, sockets or other tool members therein. Normally, the tool bits or the sockets or the other tool members may include an end portion extended out of the cavities or the socket openings of the receptacle, for allowing the tool members to be gripped or fetched by the users and to be removed from the cavities or the socket openings of the receptacle.

However, normally, the tool members may include only a short or tiny end portion extended out of the cavities or the socket openings of the receptacle, such that the tool members may not be easily gripped or fetched by the users.

U.S. Pat. No. 6,237,451 to Wei discloses one of the typical tool boxes and also comprising a receptacle including a number of cavities or socket openings formed therein for receiving tool bits, sockets or other tool members therein, and a cover rotatably attached onto the receptacle for enclosing the receptacle. The cover includes an aperture formed therein for aligning with either of the tool members, to allow the selected tool members to be gripped or fetched by the users.

However, when the aperture of the cover has been rotated and aligned with one of the tool members, the selected tool member also may not be moved out of the cavities or the socket openings of the receptacle, such that the tool members also may not be easily gripped or fetched by the users.

U.S. Pat. No. 6,327,942 to Mariol et al. discloses another typical tool box or bit drive comprising a driver handle including a number of cavities or socket openings formed therein for receiving tool bits, sockets or other tool members therein, and a bit cap rotatably attached onto the driver handle for enclosing the driver handle. The bit cap includes a spring-biased bit gate having a gate aperture formed therein for aligning with either of the tool members, to allow the selected tool members to be gripped or fetched by the users.

However, similarly, when the gate aperture of the bit gate of the bit cap has been rotated and aligned with one of the tool members, the selected tool member also may not be moved out of the cavities or the socket openings of the driver handle, such that the tool members also may not be easily gripped or fetched by the users.

The present invention has arisen to mitigate and/or obviate the afore-described disadvantages of the conventional tool boxes.

SUMMARY OF THE INVENTION

The primary objective of the present invention is to provide a tool box including a movable or slidable or spring-biased holder for movably supporting one or more tool bits, sockets or other tool members therein, and for selectively moving the tool members out of the tool box and for allowing the tool members to be easily gripped or fetched by the users.

The other objective of the present invention is to provide a tool box including a cover arranged to automatically enclose or shield or to release the tool members.

In accordance with one aspect of the invention, there is provided a tool box comprising a housing including an upper wall having a number of orifices formed therein, and a carrier slidably received in the housing, and including a number of socket openings formed therein and aligned with the orifices of the upper wall of the housing, for receiving and supporting tool members therein. The carrier is slidable relative to the housing between a working position and an inwardly storing position, for selectively moving the tool members in and out of the housing.

The carrier includes a number of barrels extended therefrom, to define the socket openings thereof. The housing includes a spring member disposed therein and engaged between the housing and the carrier, for biasing the carrier to move the tool members out of the housing.

The housing includes a guide post extended therein, and the carrier includes a bore formed therein for slidably receiving the guide post, and for guiding the carrier to move up and down relative to the housing. The carrier includes an outer diameter equals to an inner diameter of the housing, for guiding the carrier to move up and down relative to the housing.

An anchoring device may further be provided for anchoring the carrier to the housing at the inwardly storing position. The anchoring device includes a guide post extended from the housing and having a seating depression formed therein, and the carrier includes a projection extended therefrom, for engaging with the seating depression of the guide post, and for anchoring and positioning the carrier to the housing the inwardly storing position.

The guide post includes a guide slot formed therein and having an upper entrance and a lower guide way formed therein and communicating with each other, and having the seating depression formed in the lower portion thereof and communicating with the lower guide way of the guide slot thereof. The guide post includes an inclined guide ramp formed in the lower guide way thereof, for disengaging the projection of the carrier from the seating depression of the guide post, when the projection of the carrier is moved downwardly from the seating depression of the guide post.

The carrier includes a tube attached thereto and having the projection extended from the tube. The carrier includes a spring blade formed in the tube and having the projection extended from the spring blade of the tube. The carrier includes a chamber formed therein for receiving the tube, and at least one lock perforation formed therein and communicating with the chamber thereof, and the tube includes at least one latch extended therefrom for engaging through the lock perforation of the carrier, and for locking the tube to the carrier.

A cover may further be provided and rotatably attached to the housing, and includes a number of passageways formed therein, for selectively aligning with the orifices of the upper wall of the housing, and for selectively offsetting from the orifices of the housing. The carrier includes a stem extended therefrom, and the cover includes a bore formed therein for slidably and rotatably receiving the stem of the carrier.

The stem includes a guide groove formed therein, and the cover includes a jut extended therefrom, for slidably engaging into the guide groove of the stem, and for guiding the cover to move relative to the stem of the carrier. The guide groove of the stem includes an inclined upper inlet formed therein, for slidably engaging with the jut of the cover, and for rotating the cover relative to the housing, in order to selectively offset the passageways of the cover from the orifices of the housing.

The cover includes at least one guide notch formed therein, and the housing includes at least one guide protrusion extended therefrom and slidably received and engaged with the guide notch of the cover, for limiting the cover to slide relative to the housing.

A receptacle may further be provided and may include an outer container having a hollow chamber formed therein for receiving the housing. The outer container includes at least one channel formed therein, and the housing includes a lower casing and an upper casing each having at least one rib extended outwardly therefrom, for force-fitting into the channel of the outer container, and for securing the housing within the outer container.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
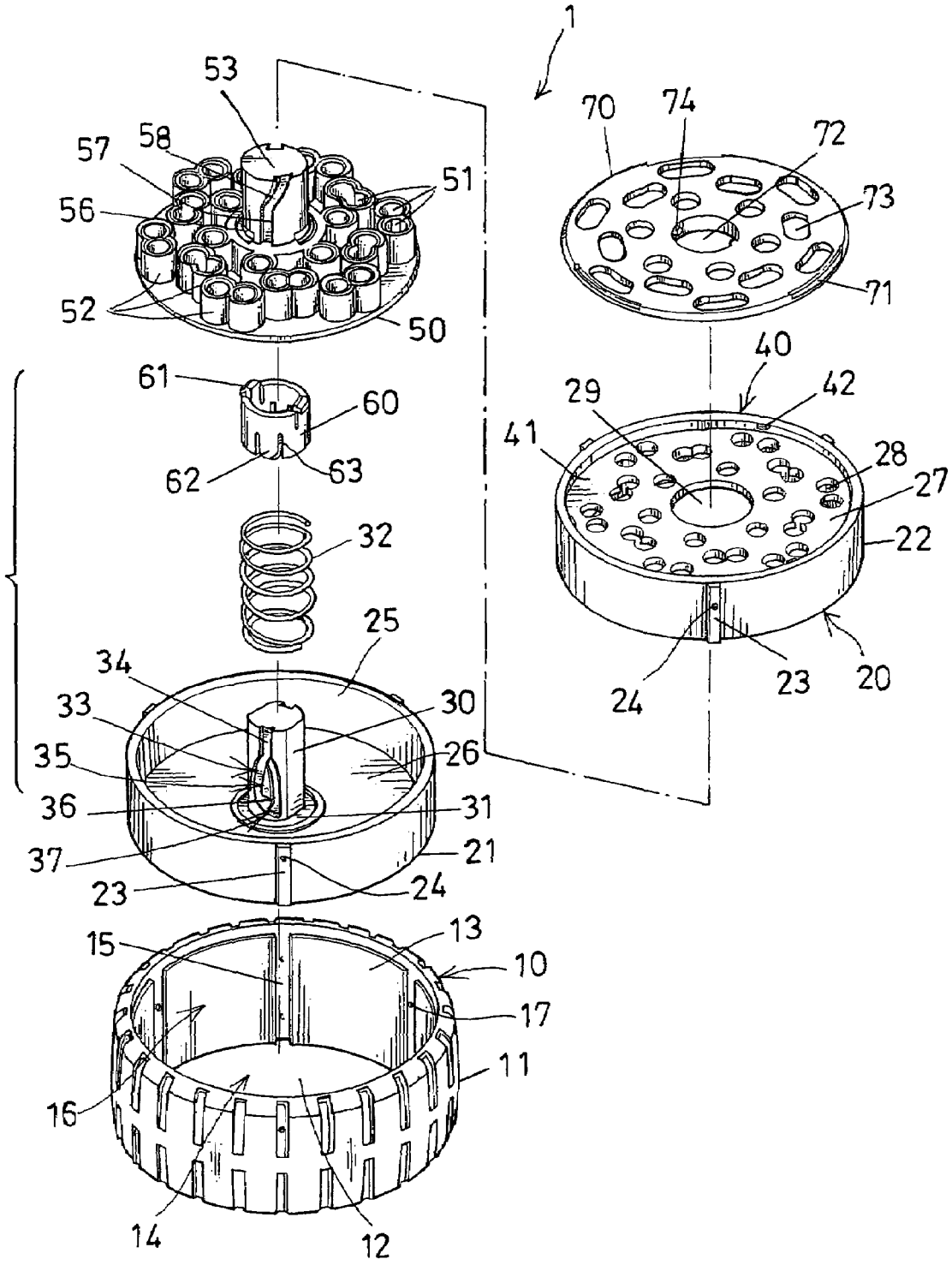
FIG. 1 is an exploded view of a tool box in accordance with the present invention.
Figure 2:
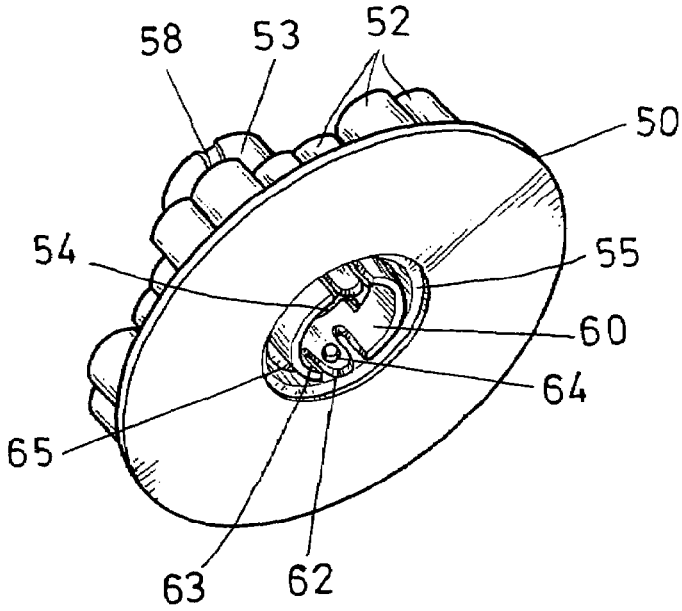
FIG. 2 is a bottom perspective view illustrating a tool holder for the tool box.
Figure 3:
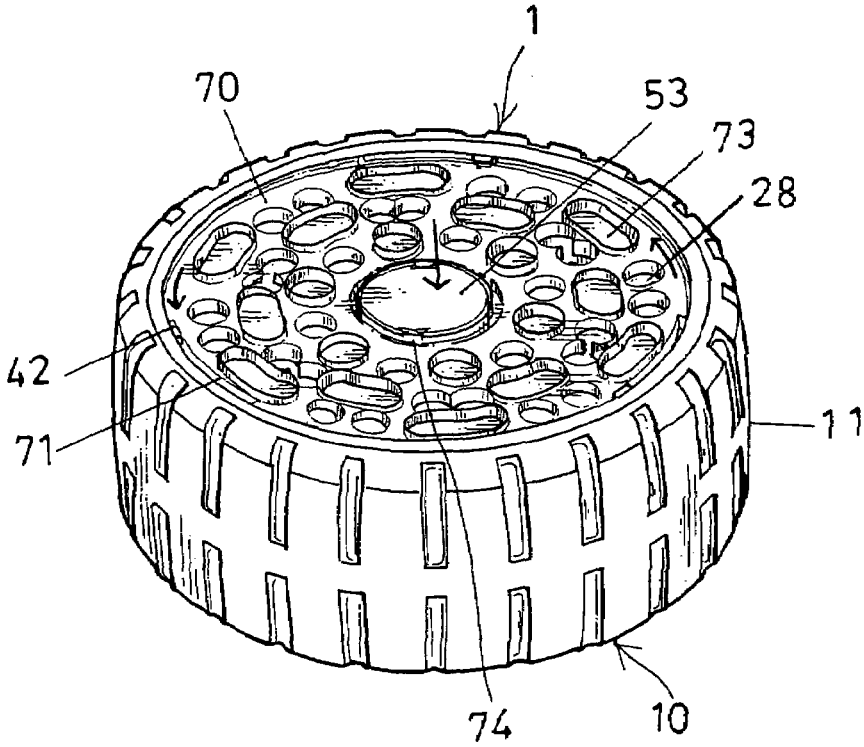
FIG. 3 is a perspective view of the tool box.

Referring to the drawings, and initially to FIGS. 1-3, a tool box 1 in accordance with the present invention comprises a receptacle 10 including an outer container 11 having a hollow chamber 12 formed therein and preferably having an open top 13 and/or an open bottom 14 formed therein, best shown in FIG. 1. The outer container 11 includes one or more vertical or longitudinal channels 15 formed in an inner peripheral surface 16 thereof, and one or more catches or cavities 17 extended therefrom or formed therein.

The receptacle 10 further includes a housing 20 having such as a lower casing 21 and an upper casing 22, received or engaged into the hollow chamber 12 of the outer container 11, and secured to the outer container 11 with such as force-fitted engagements. It is preferable that the lower and the upper casings 21, 22 each includes one or more vertical or longitudinal ribs 23 extended outwardly therefrom, for force-fitting into the corresponding channels 15 of the outer container 11, and for securing or anchoring the housing 20 within the outer container 11.

It is further preferable that the lower and the upper casings 21, 22 each includes one or more cavities or catches 24 formed therein or extended therefrom, for engaging with the corresponding catches or cavities 17 of the outer container 11, and for further stably securing or anchoring the housing 20 within the outer container 11. Alternatively, the lower casing 21 and/or the upper casing 22 may also be formed integral with each other, or solidly secured together, or secured to the outer container 11 with such as adhesive materials, or by welding processes, or by fasteners or latches (not shown).

The lower casing 21 of the housing 20 includes a space 25 formed therein, and a guide post 30 extended from a bottom wall 26 thereof and extended into the space 25 thereof, and preferably includes an annular or peripheral recess 31 formed therein, and arranged around the guide post 30 for receiving or seating a spring member 32 therein. The guide post 30 may be slightly extended upwardly beyond the upper portion of the lower casing 21.

Figure 6:
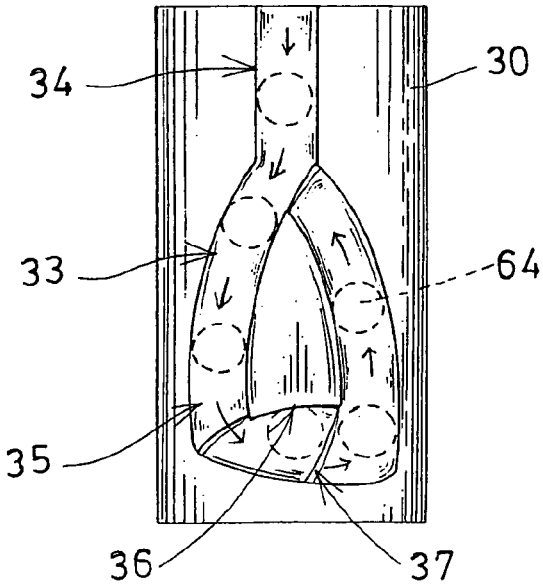
FIG. 6 is an enlarged plan schematic view illustrating the operation of the tool box.

As shown in FIGS. 1 and 6, the guide post 30 includes one or more, such as two substantially σ-shaped guide slots 33 oppositely formed therein and each having an upper entrance 34 and a substantially U-shaped or delta or Δ-shaped lower guide way 35 formed therein, and communicating with each other, and each having a seating depression 36 formed in the lower portion thereof and communicating with the lower guide way 35 of the guide slot 33, and each having an inclined guide ramp 37 formed in the lower portion of the lower guide way 35 of the guide slot 33 thereof.

The upper casing 22 of the housing 20 includes an upper wall 27 having a number of orifices 28 formed therein, and a bore 29 formed in the center portion thereof. It is preferable that the upper wall 27 is formed or disposed slightly lower than the top or the upper portion 40, to form a peripheral shoulder or a compartment 41 in the upper portion 40 of the upper casing 22 of the housing 20. The upper casing 22 of the housing 20 further includes one or more guide protrusions 42 extended from the upper portion 40 thereof and extended into the compartment 41 thereof.

A movable or slidable holder or carrier 50 is slidably received in the space 25 of the lower casing 21 of the housing 20, and preferably includes an outer diameter equals to or slightly smaller than the inner diameter of the lower casing 21, for stably guiding the carrier 50 to move up and down relative to the lower casing 21, and for preventing the carrier 50 from moving sidewise relative to the lower casing 21.

The carrier 50 includes a number of socket openings 51 formed therein and defined by barrels 52 respectively, and aligned with the orifices 28 of the upper wall 27 of the upper casing 22 of the housing 20, for receiving or supporting various tool members 80, such as tool bits 80 (FIG. 4), sockets 80 (FIG. 5), or other tool members 80 therein, and for selectively moving the tool members 80 out of the orifices 28 of the upper wall 27 of the upper casing 22 (FIGS. 4, 5), when the carrier 50 is moved upwardly relative to the upper casing 22 of the housing 20.

The carrier 50 further includes a stem 53 extended upwardly therefrom, and a bore 54 formed therein (FIG. 2), for slidably receiving the guide post 30, and for further stably guiding the carrier 50 to move up and down relative to the lower casing 21, and further includes an enlarged chamber 55 formed in the bottom portion thereof (FIG. 2), and one or more lock perforations 56 formed therein and communicating with the chamber 55 thereof, and further includes one or more, such as two guide grooves 57 oppositely formed therein and each having an inclined upper inlet 58 formed therein.

The stem 53 may further include an engaging hole formed therein (not shown) for receiving and engaging and rotating the tool members 80. Alternatively, the lower casing 21 and/or the housing 20 may further include an engaging hole formed in the bottom portion thereof (not shown) for receiving and engaging and rotating the tool members 80. The formation and the provision of the engaging holes of the lower casing 21 and/or the housing 20 and/or in the stem 53 is not related to the present invention, and will not be described in further details.

As shown in FIG. 2, a tube 60 is engaged into the chamber 55 of the carrier 50, and includes one or more latches 61 extended therefrom (FIG. 1), for engaging through the lock perforations 56 of the carrier 50, and for engaging with the carrier 50, in order to lock and to secure the tube 60 to the carrier 50. The tube 60 includes one or more spring legs or spring blades 62 extended therefrom or formed therein, and each defined by one or more slots or gaps 63, and each having a spring-biased projection 64 extended inwardly therefrom (FIG. 2), for slidably engaging with the guide slots 33 of the guide post 30 (FIG. 6).

It is preferable that the tube 60 includes an outer diameter smaller than the inner diameter of the chamber 55 of the carrier 50, for forming an annular or peripheral space 65 between the tube 60 and the carrier 50 (FIG. 2), and for receiving the upper portion of the spring member 32, and thus for anchoring or positioning the spring member 32 to the carrier 50, or for anchoring or positioning the spring member 32 between the carrier 50 and the lower casing 21 of the housing 20.

The spring member 32 may be used as a spring biasing means or device to bias and to move the carrier 50 upwardly along the guide post 30, and thus to the tool members 80 out through the orifices 28 of the upper wall 27 of the upper casing 22 (FIGS. 4, 5), and thus to allow the tool members 80 to be easily gripped or fetched by the users. Alternatively, without the spring member 32, the carrier 50 may also be moved upwardly along the guide post 30 by gripping and pulling and moving the stem 53 of the carrier 50 by the users. The carrier 50 may further include a handle or hand grip (not shown) extended upwardly from the stem 53 thereof, for allowing the stem 53 of the carrier 50 to be easily gripped and pulled by the users.

The tool members 80 may also be moved or stored within the housing 20 by moving the carrier 50 into the lower casing 21 of the housing 20, such that the carrier 50 may be moved relative to the housing 20 between an outwardly working position and an inwardly storing position. The prior tool boxes fail to teach a carrier 50 slidably received in a housing 20, to receive and to support tool members 80 therein, and to selectively move the tool members 80 into and out of the housing 20. The provision and the engagement of the spring member 32 between the carrier 50 and the lower casing 21 of the housing 20 may bias and move the tool members 80 out of the housing 20 automatically.

As shown in FIG. 6, when the tube 60 and the carrier 50 are moved downwardly along the guide post 30, the projections 64 of the spring blades 62 of the tube 60 may be forced to move downwardly from the upper entrances 34 toward the lower guide ways 35 of the guide slots 33 of the guide post 30, and will then be guided to engage with the seating depressions 36 of the guide post 30, in order to anchor and position and to retain the carrier 50 and the tool members 80 within the housing 20, or in the inwardly storing position within the housing 20.

When the stem 53 or the carrier 50 is further depressed or moved into the housing 20 against the spring member 32, or when the projection of the carrier is moved downwardly from the seating depression of the guide post, the inclined guide ramp 37 of the guide post 30 may force or guide the projections 64 of the spring blades 62 of the tube 60 to move sidewise toward the other side of the lower guide ways 35 of the guide slots 33 of the guide post 30, and thus to allow the projections 64 of the spring blades 62 of the tube 60 to be moved upwardly into the upper entrances 34 of the guide slots 33 of the guide post 30 again, by the spring member 32. The projections 64 of the tube 60 and the guide slots 33 of the guide post 30 may thus be formed as an anchoring means or device for anchoring and retaining the carrier 50 and the tool members 80 within the housing 20 at the storing position.

The tool box 1 further includes a cover 70 rotatably received within the compartment 41 of the upper casing 22 of the housing 20, and includes one or more guide notches 71 formed in the outer peripheral portion thereof, for slidably receiving or engaging with the guide protrusions 42 of the upper casing 22 of the housing 20, and thus for guiding and for limiting the cover 70 to slide relative to the upper casing 22 of the housing 20 within a predetermined moving stroke.

The cover 70 includes a bore 72 for slidably and rotatably receiving the stem 53 of the carrier 50, and includes a number of passageways 73 formed therein, for selectively aligning with the orifices 28 of the upper wall 27 of the upper casing 22 of the housing 20 (FIGS. 4, 5), and thus for allowing the tool members 80 to be moved outwardly through the passageways 73 of the cover 70. Alternatively, the cover 70 may also be rotated relative to the housing 20, to offset the passageways 73 thereof from the orifices 28 of the upper casing 22 of the housing 20 (FIG. 3), and to engage and to enclose and to retain the tool members 80 within the housing 20.

Figure 4:
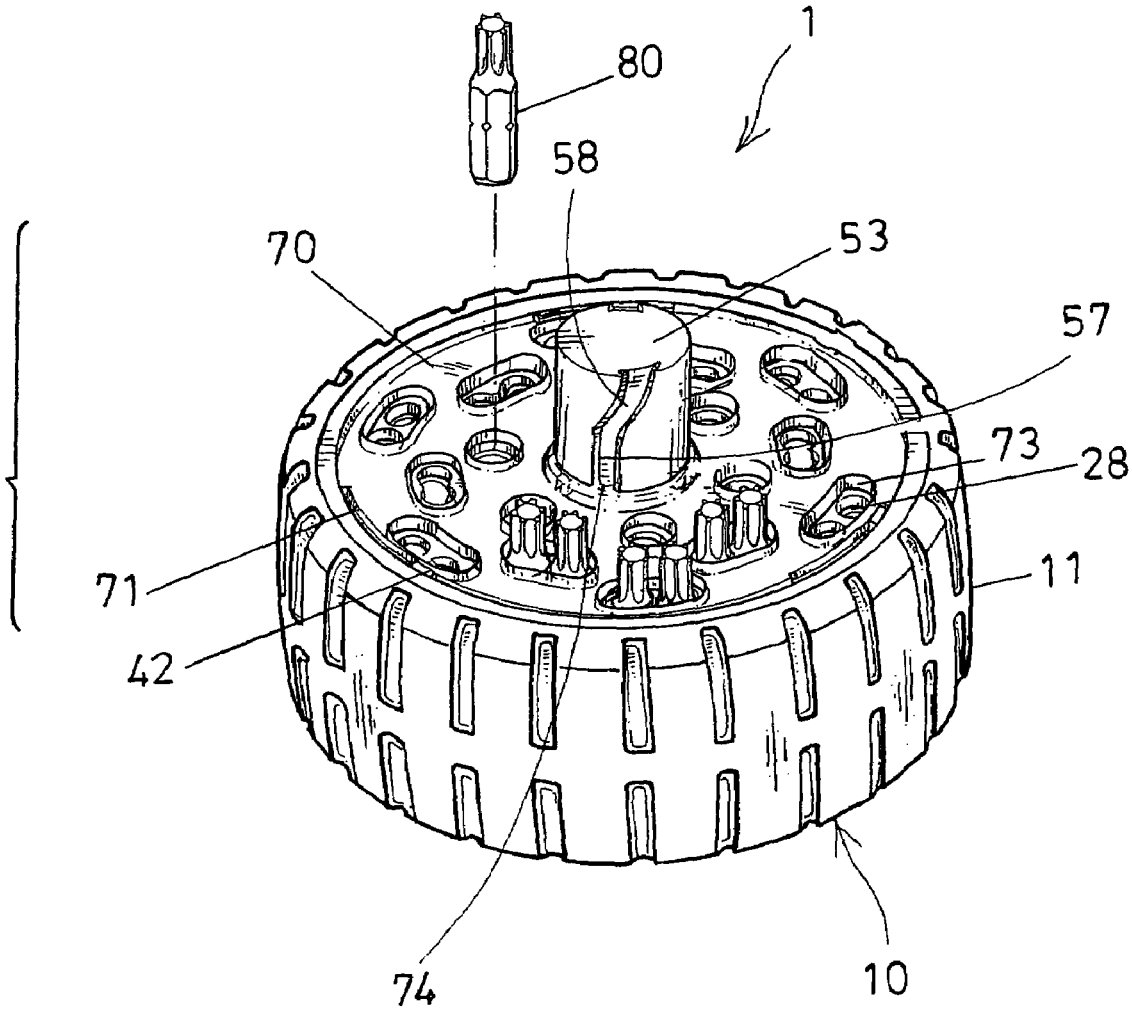
FIGS. 4 and 5 are partial exploded views illustrating the operation of the tool box.
Figure 5:
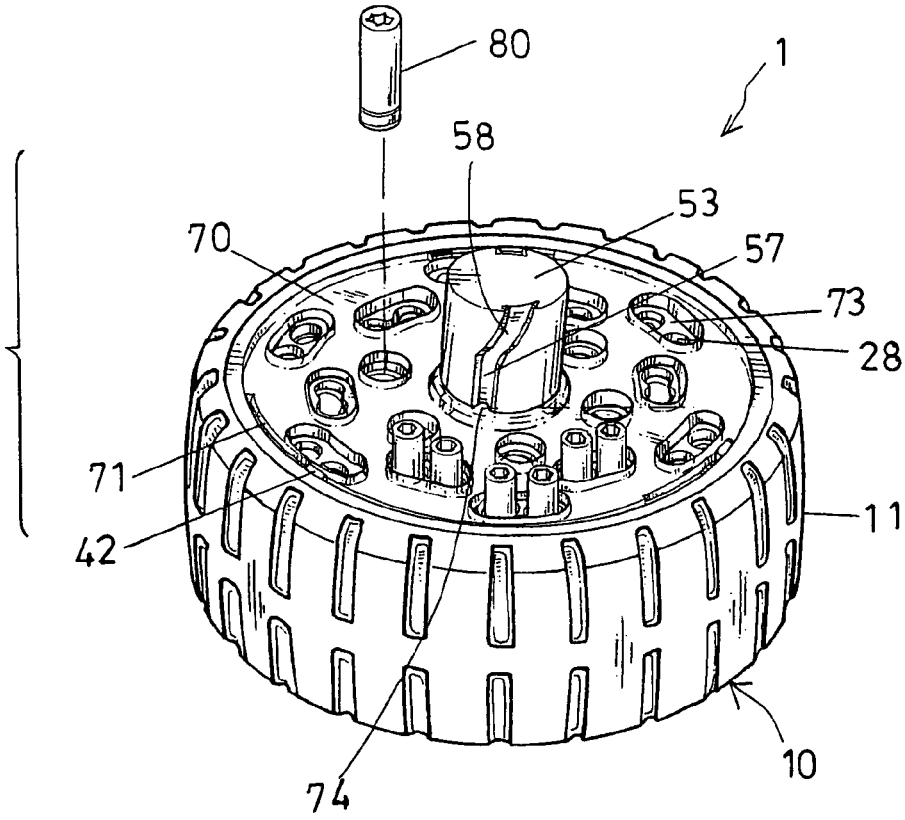

The cover 70 includes one or more, such as two juts 74 extended into the bore 72 thereof, for slidably engaging into the guide grooves 57 and the inclined upper inlets 58 of the carrier 50. For example, as shown in FIGS. 4 and 5, when the juts 74 of the cover 70 are slidably engaged within the guide grooves 57 of the carrier 50, the passageways 73 of the cover 70 are arranged to be aligned with the orifices 28 of the housing 20, to allow the tool members 80 to be moved outwardly through the passageways 73 of the cover 70.

On the contrary, as shown in FIG. 3, when the juts 74 of the cover 70 are slidably engaged within the inclined upper inlets 58 of the carrier 50 and when the stem 53 or the carrier 50 is depressed or moved into the housing 20 against the spring member 32, the passageways 73 of the cover 70 may be moved and arranged to be offset from the orifices 28 of the housing 20, to engage and to enclose and to retain the tool members 80 within the housing 20, and thus to prevent the tool members 80 from being disengaged from the housing 20.

Accordingly, the tool box in accordance with the present invention includes a movable or slidable or spring-biased holder for movably supporting one or more tool bits, sockets or other tool members therein, and for selectively moving the tool members out of the tool box and for allowing the tool members to be easily gripped or fetched by the users, and includes a cover arranged to automatically enclose or shield or to release the tool members when required.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A tool box comprising:

a housing including an upper wall having a plurality of orifices formed therein, and including a guide post extended from said housing, said guide post including a guide slot formed therein and having an upper entrance and a lower guide way formed therein and communicating with each other, and including a seating depression formed in said guide post and communicating with said lower guide way of said guide slot of said guide post, and a carrier slidably received in said housing, and including a plurality of socket openings formed therein and aligned with said orifices of said upper wall of said housing, for receiving and supporting tool members therein, said carrier being slidable relative to said housing between a working position and an inwardly storing position, for selectively moving the tool members in and out of said housing, and said carrier including a projection extended therefrom, for engaging with said seating depression of said guide post, and for anchoring and positioning said carrier to said housing at said inwardly storing position.

2. The tool box as claimed in claim 1, wherein said carrier includes a plurality of barrels extended therefrom, to define said socket openings thereof.

3. The tool box as claimed in claim 1, wherein said housing includes a spring member disposed therein and engaged between said housing and said carrier, for biasing said carrier to move the tool members out of said housing.

4. The tool box as claimed in claim 1, wherein said carrier includes a bore formed therein for slidably receiving said guide post, and for guiding said carrier to move up and down relative to said housing.

5. The tool box as claimed in claim 1, wherein said carrier includes an outer diameter equals to an inner diameter of said housing, for guiding said carrier to move up and down relative to said housing.

6. The tool box as claimed in claim 1, wherein said guide post includes an inclined guide ramp formed in said lower guide way thereof, for disengaging said projection of said carrier from said seating depression of said guide post, when said projection of said carrier is moved downwardly from said seating depression of said guide post.

7. The tool box as claimed in claim 1, wherein said carrier includes a tube attached thereto and having said projection extended from said tube.

8. The tool box as claimed in claim 7, wherein said carrier includes a spring blade formed in said tube and having said projection extended from said spring blade of said tube.

9. The tool box as claimed in claim 7, wherein said carrier includes a chamber formed therein for receiving said tube, and at least one lock perforation formed therein and communicating with said chamber thereof, and said tube includes at least one latch extended therefrom for engaging through said at least one lock perforation of said carrier, and for locking said tube to said carrier.

10. The tool box as claimed in claim 1 further comprising a cover rotatably attached to said housing, and including a plurality of passageways formed therein, for selectively aligning with said orifices of said upper wall of said housing, and for selectively offsetting from said orifices of said housing.

11. The tool box as claimed in claim 10, wherein said carrier includes a stem extended therefrom, and said cover includes a bore formed therein for slidably and rotatably receiving said stem of said carrier.

12. The tool box as claimed in claim 11, wherein said stem includes a guide groove formed therein, and said cover includes a jut extended therefrom, for slidably engaging into said guide groove of said stem, and for guiding said cover to move relative to said stem of said carrier.

13. The tool box as claimed in claim 12, wherein said guide groove of said stem includes an inclined upper inlet formed therein, for slidably engaging with said jut of said cover, and for rotating said cover relative to said housing, in order to selectively offset said passageways of said cover from said orifices of said housing.

14. The tool box as claimed in claim 1, wherein said cover includes at least one guide notch formed therein, and said housing includes at least one guide protrusion extended therefrom and slidably received and engaged with said at least one guide notch of said cover, for limiting said cover to slide relative to said housing.

15. The tool box as claimed in claim 1 further comprising a receptacle including an outer container having a hollow chamber formed therein for receiving said housing.

16. The tool box as claimed in claim 15, wherein said outer container includes at least one channel formed therein, and said housing includes a lower casing and an upper casing each having at least one rib extended outwardly therefrom, for force-fitting into said at least one channel of said outer container, and for securing said housing within said outer container.

* * * * *